US006152787A

United States Patent [19]

Serbin et al.

[11] Patent Number: 6,152,787

[45] Date of Patent: Nov. 28, 2000

[54] ONE PIECE TERMINAL

[75] Inventors: Bruce J. Serbin, Canfield; Robert L. Sten, Warren; James D. Daugherty, Brookfield, all of Ohio

[73] Assignee: Delphi Technologies, Inc., Troy, Mich.

[21] Appl. No.: 09/385,160

[22] Filed: Aug. 30, 1999

[51] Int. Cl.[7] ..... H01R 13/11

[52] U.S. Cl. ..... 439/852

[58] Field of Search ..... 439/852, 843, 439/839, 851

[56] References Cited

U.S. PATENT DOCUMENTS

| | | | |
|---|---|---|---|
| 5,147,230 | 9/1992 | Plyer et al. | 439/851 |
| 5,338,229 | 8/1994 | Egenolf | 439/839 |
| 5,340,337 | 8/1994 | Pentz | 439/843 |
| 5,720,634 | 2/1998 | Sten | 439/843 |

*Primary Examiner*—Paula Bradley
*Assistant Examiner*—Briggitte R. Hammond
*Attorney, Agent, or Firm*—Richard A. Jones

[57] ABSTRACT

A miniaturized female electrical terminal (100) having single piece construction which provides positive locking in a sealed system type connector and ability to visually inspect for manufacturing defects, even wherein the outer barrel diameter is less than 1.80 millimeters. The female electrical terminal includes a terminal portion (102), a cable connection portion (104) and an intermediate neck (106) located therebetween. The terminal portion includes an inner barrel (108) which is concentrically located within an outer barrel (110) and connected thereto by a strap (116). A forward end portion of the inner barrel is composed of a first terminal arm (112), a second terminal arm (114) and a portion of the strap, which are annularly arranged to provide a three-point female terminal contact (118). The cable connection portion includes a pair of wire crimp wings (120), a pair of insulation jacket crimp wings (122) at an enlarged diameter area (124), and a neck transition area (126). The intermediate neck is integral with and located between the inner barrel and the neck transition area.

12 Claims, 4 Drawing Sheets

ONE PIECE TERMINAL

TECHNICAL FIELD

The present invention relates to female electrical terminals, and more particularly to a female electrical terminal of single piece construction.

BACKGROUND OF THE INVENTION

Referring to FIGS. 1 and 2 a prior art single piece female electrical terminal 10 is depicted which is described in U.S. Pat. No. 5,720,634, issued Feb. 24, 1998 to Sten. This female electrical terminal is used for "plug through" type sealed electrical connectors, wherein an elastomeric seal is located at the cable end of the connector body. In this environment of operation, the electrical female terminals are inserted through holes in the seal as they are seated into the connector body, thereby sealing the cable with respect to the connector.

An attachment portion 12 at one end of the female electrical terminal 10 includes wire crimp wings 14 and cable crimp wings 16. At the opposite end, the female electrical terminal 10 has a contact portion 18. The contact portion 18 includes a split outer barrel 20 and a reduced diameter intermediate neck 22 which attaches the contact portion 18 to the attachment portion 12. The outer barrel 20 has two longitudinal edges 24 which define a split 26 when joined together.

A front end of the outer barrel 20 has a curled annular lip 28. Joined to the front end of the barrel 20 is a connection strap 30. The connection strap, when the outer barrel 20 is formed, is joined to the outer barrel generally opposite the longitudinal edges 24 (generally along the longitudinal centerline of the barrel). The connection strap 30 is folded rearwardly into the outer barrel 20. The connection strap juxtaposes two spring contact or support beams 32. The support beams 32 have an overall length represented by dimension 34. The support beams 32 have an overall length to length of joinder to the midstrap ratio of between 2.5:1 to 1.5:1. In the embodiment of FIG. 2, dimension 34 is 5.50 millimeters. The distance from the end of the contact beam to the outer barrel dimension 40 is approximately 0.75 millimeters.

A front portion of the support beams 32 form contact fingers 36. Preferably, section 38 of the contact fingers 36 will be plated with gold or like material to enhance contact interface characteristics. The remainder of the terminal may be copper or other suitable conductor.

The front edges of the contact fingers 36 extend toward the front end of the barrel 20 and are radially spring-biased inwardly when contacting a mating end (male pin) terminal (not shown). When fully formed, the support beams 32 and connection strap 30 form an inner barrel 42 which is almost essentially independent of the outer barrel 20. The contact fingers 36 typically will be inclined at 4 to 8 degrees and preferably 6 degrees from the axial centerline of the female electrical terminal. From the neck area 46, the intermediate neck 22 is formed, wherein a shoulder 45 is formed adjacent the intermediate neck 22 which serves as a positive lock location with respect to a lock abutment member of a connector.

The female electrical terminal 10 is formed from strip stock having an interface plating region which generally corresponds to section 38 of the contact fingers after forming. The first portion of the female electrical terminal 10 which is stamped is the connection strap 30 along with the support beams 32. As the female electrical terminal progresses down the assembly line, portions of the attachment portion are singulated from the rest of the stock material.

One of the advantages of the single piece configuration of the female electrical terminal 10 is the ability, as shown at FIG. 3, to optically inspect the female electrical terminal for manufacturing discrepancy. In the example depicted, a light source 48 shines a light beam 50 through a female electrical terminal 10', including a narrow intermediate neck 22', to an optical receiver 52. Optical inspection is mandated by the increasing dependence of reliable electrical interfacing in critical electrical circuits, such as for example those associated with supplemental restraint systems and anti-lock brake systems.

While the prior art female electrical terminal 10 performs well when configured at a size whereat the outer barrel 20 has a diameter of 2.00 millimeters (the intermediate neck having a diameter of 1.20 millimeters), there is a need to provide a single piece construction female electrical terminal which has a smaller diameter, yet retains the features of optical inspection and sealable interface with a connector. The smallest practical diameter of the outer barrel of the prior art female electrical terminal 10 is about 1.80 millimeters, and the smallest generally acceptable intermediate neck diameter thereof is about 0.90 millimeters. Problematically, if the female electrical terminal 10 is reduced in size below a diameter of 1.80 millimeters, the locking shoulder will become unacceptably ill-defined for positive locking in a connector and the neck area will become so reduced that strength and optical inspection are compromised.

Accordingly, what remains needed in the art is a miniaturized female electrical terminal of single piece construction which affords both positive locking in a sealed system type connector and ability to visually inspect for manufacturing irregularities wherein the outer barrel diameter is less than 1.80 millimeters.

SUMMARY OF THE INVENTION

The present invention is a female electrical terminal having single piece construction which provides positive locking in a sealed system type connector and ability to visually inspect for manufacturing defects, even wherein the outer barrel diameter is less than 1.80 millimeters.

A metal blank is die cut and formed to provide the female electrical terminal according to the present invention. The die cutting of the blank provides a primary blank body, a secondary blank body and a strap integrally interconnecting these. A forward portion of the primary blank body is configured into an inner barrel, wherein two terminal arms are formed and annularly arranged with the strap. These terminal arms and the strap collectively form a female terminal contact for mutually receiving, for example, a square or round male terminal pin. A generally U-shaped cable connection portion is formed at a rear end portion of the primary blank body, and a reduced diameter intermediate neck is formed of the main blank body between the inner barrel and the cable connection portion. The intermediate neck is maintained at a minimum of, for example, 0.90 millimeters, which enables use of an optical defect inspection system.

The secondary blank body is folded back, via bending of the strap, into parallel, side-by-side adjacency with the inner barrel. The secondary blank body is then cylindrically formed into an outer barrel concentrically arranged with respect to the inner barrel, wherein the diameter thereof is, for example, 1.50 millimeters.

While the female electrical terminal according to the present invention may be miniaturized as compared to prior art female electrical terminals, it may also be made of any larger size and serve as a substitute therefor. The combination of the inner and outer barrels provides a terminal portion of the female electrical terminal. A rear edge of the outer barrel forms an abrupt, well defined annular shoulder which provides a positive locking feature with respect to a connector locking member well known in the art. The definition of the annular shoulder is enhanced by being radially off-set from the intermediate neck by its being initially formed forward of the rear edge.

It is preferred for the outer barrel to be in some manner interlocked with the inner barrel to provide enhanced robustness. In a preferred example, a window is formed at a rearward end of the inner barrel opposite the tab and lock tabs are formed on the secondary blank body. When the outer barrel is formed wrappingly around the inner barrel, the tabs are engaged seatably into the window. However, other configurations may be used to provide interlocking. For example, the window may be located on the other side of the inner barrel due to tooling considerations.

Accordingly, it is a preferred object of the present invention to provide a female electrical terminal of single piece construction, which is miniaturizable to an outer barrel diameter of, for example, less than 1.8 millimeters, wherein the terminal is positively lockable with respect to sealed connectors.

This, and additional objects, advantages, features and benefits of the present invention will become apparent from the following specification.

DESCRIPTION OF THE PREFERRED EMBODIMENT

Figure 1:
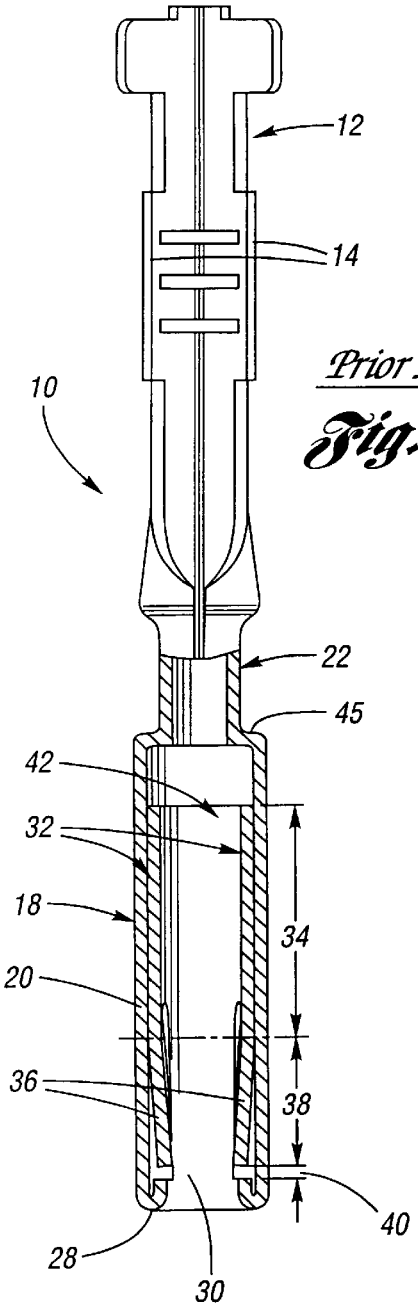
Prior Art Fig. 1
FIG. 1 is a plan view of a prior art female electrical terminal.
Figure 2:
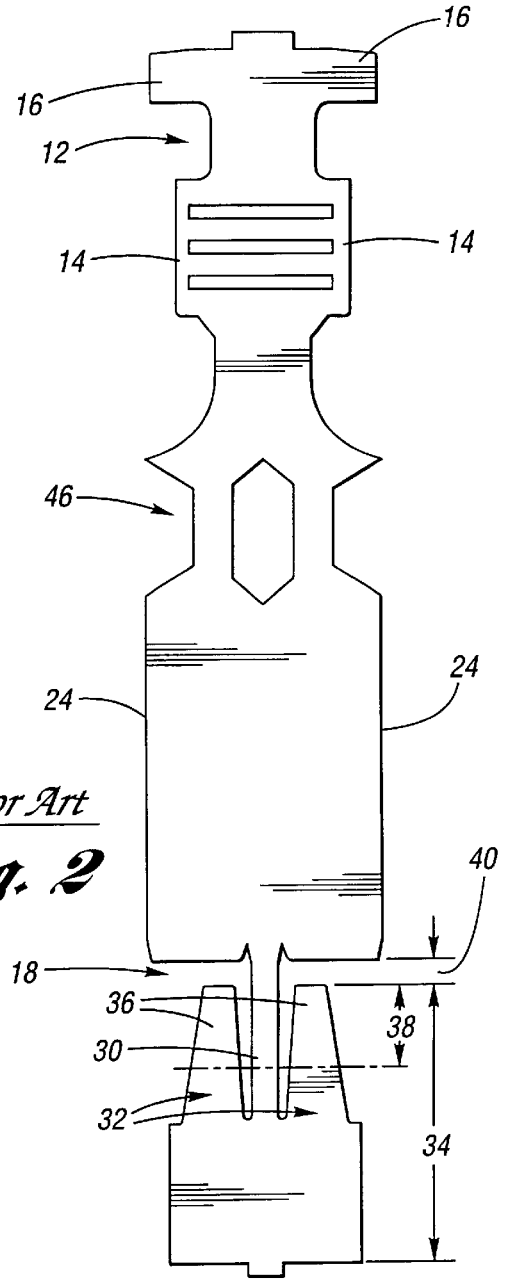
Prior Art Fig. 2
FIG. 2 is a die cut blank from which the prior art female electrical terminal of FIG. 1 is formed.
Figure 3:
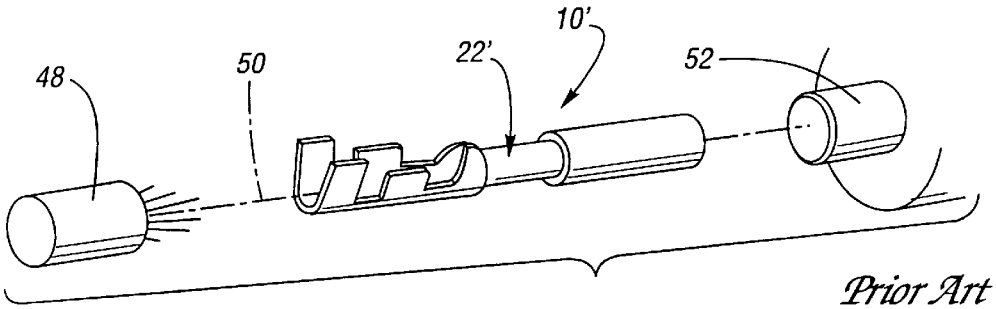
Prior Art Fig. 3
FIG. 3 is a perspective view of a prior art method of optically testing a female electrical terminal for manufacturing defects.
Figure 4:
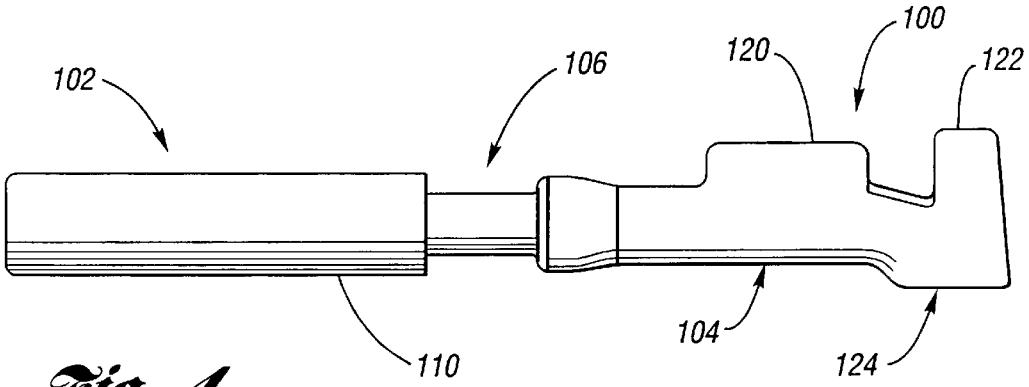
FIG. 4 is a side elevational view of a female electrical terminal according to the present invention.

Referring now to the Drawings, FIGS. 4 through 11 generally depict various aspects of the female electrical terminal 100 according to the present invention. As can be seen by reference to FIGS. 4 through 8, the female electrical terminal 100 includes a terminal portion 102, a cable connection portion 104 and an intermediate neck 106 located therebetween. The terminal portion 102 includes an inner barrel 108 which is concentrically located within an outer barrel 110, wherein a forward end portion of the inner barrel is composed of a first terminal arm 112, a second terminal arm 114 and a strap 116, which are annularly arranged to provide a three-point female terminal contact 118. The cable connection portion 104 includes a pair of wire crimp wings 120, a pair of insulation jacket crimp wings 122 at an enlarged diameter area 124, and a neck transition area 126. The intermediate neck 106 is integral with and located between the inner barrel 108 and the neck transition area 126.

Figure 5:
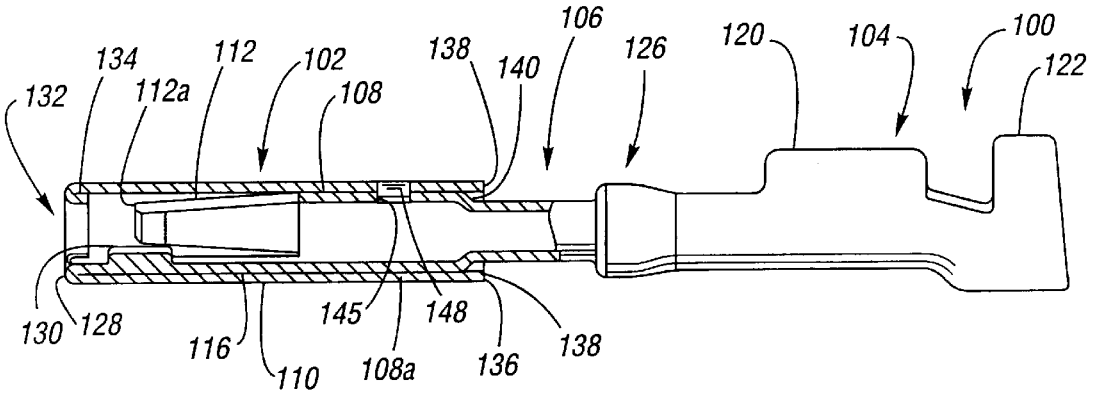
FIG. 5 is a partly sectional side view of the female electrical terminal according to the present invention.
Figure 6:
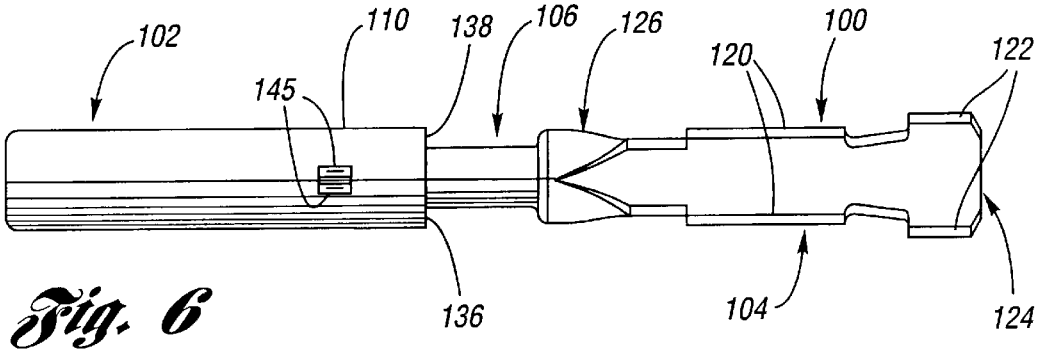
FIG. 6 is a top plan view of the female electrical terminal according to the present invention.
Figure 7:
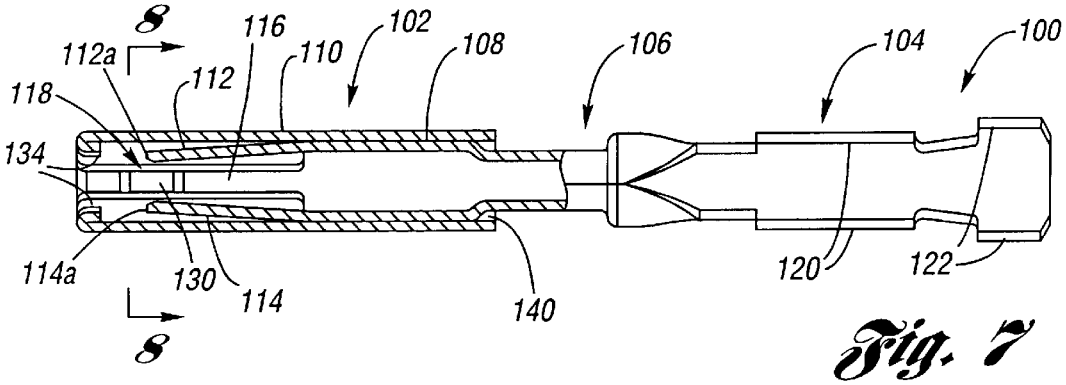
FIG. 7 is a partly sectional top view of the female electrical terminal according to the present invention.
Figure 8:
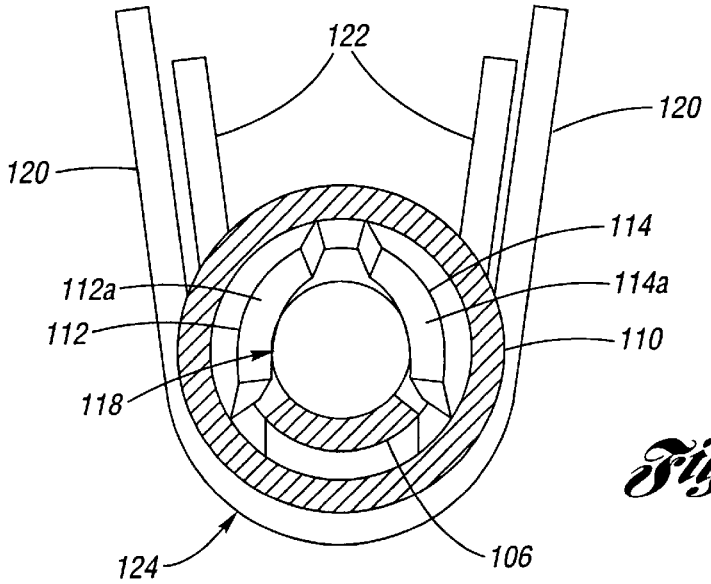
FIG. 8 is a partly sectional view of the female electrical terminal according to the present invention, seen along line 8—8 of FIG. 7.

As can be seen best by simultaneous comparison with FIGS. 5, 7, and 8, the first and second terminal arms 112, 114 are differentiated beginning at a rear end portion 108*a* of the inner barrel 108, and have a taper toward the respective distal ends 112*a*, 114*a* thereof, whereat is located the female terminal contact 118. The strap 116 is provided with a back-fold 128 and an embossment 130 which forms a point of the three-point female terminal contact 118. The diameter of the opening formed at the female terminal contact 118 is predetermined so that a male terminal pin will contact the distal ends 112*a*, 114*a* and the embossment 130, wherein the first and second terminal arms are radially deflectable, in a resilient manner, when a male terminal pin is inserted into the female terminal contact. For example, a female terminal contact 118 having a diameter of 0.5 millimeters may receive a 0.64 diameter round cross-section male terminal pin or a 0.5 millimeter square cross-section terminal pin.

The outer barrel 110 protects the female terminal contact 118 from injury and provides an entry port 132 for defining initial entry of a male terminal pin. In this regard, it is preferred to include a fold-over lip 134 at the entry port 132 for added strength and to provide a smooth entry guidance surface for the male pin terminal. The rear end 136 of the outer barrel provides a sharply defined annular shoulder 138, suitable for engagement in a known manner with a resilient lock arm feature of a connector. Generally, the inner and outer barrels 108, 110 are, for the most part, separately distinct, with the outer barrel serving to help prevent the inner barrel from spreading, while yet allowing radial deflection of the first and second terminal arms. It is preferred to provide an interlock between the inner and outer barrels, wherein tabs 148 formed on the outer barrel 110 are seated into a window 145 formed in the inner barrel 108 to thereby amplify the robust integrity of the outer barrel. The exact location and configuration of the tabs and window may be altered.

The intermediate neck 106 has a reduced diameter as compared with the diameter of the inner barrel 108, via a reduction taper 140. Because the outer barrel 110 concentrically wraps the entire inner barrel 108 (inclusive of the female terminal contact 118), the diameter of the outer barrel may be made very small and yet the annular shoulder 138 will be well defined. For example, the diameter of the outer barrel may be made less than 1.8 millimeters, such as for example 1.5 millimeters or even less, yet the annular shoulder will be well defined and operable with respect to a connector resilient lock arm. Indeed, the definition of the annular shoulder 138 is even further enhanced by the reduction taper 140 being located forward of the rear end 136, as best shown at FIGS. 5 and 7 whereat the annular shoulder is shown radially off-set from the intermediate neck 106. It is to be noted that while the female electrical terminal 100 may be miniaturized as compared to prior art female electrical terminals, it may also be made of any larger size and serve as a substitute therefor.

Figure 9:
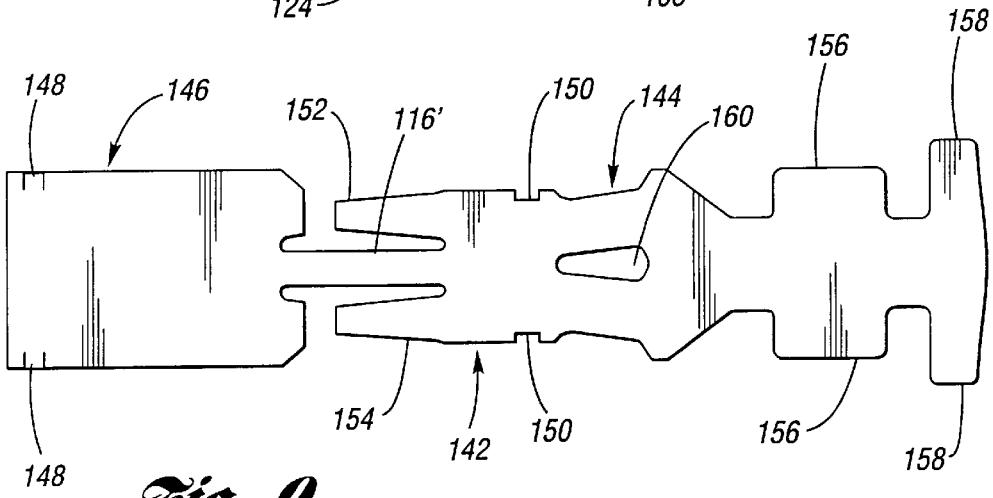
FIG. 9 is a top plan view of a die cut blank for forming the female electrical terminal according to the present invention.
Figure 10:
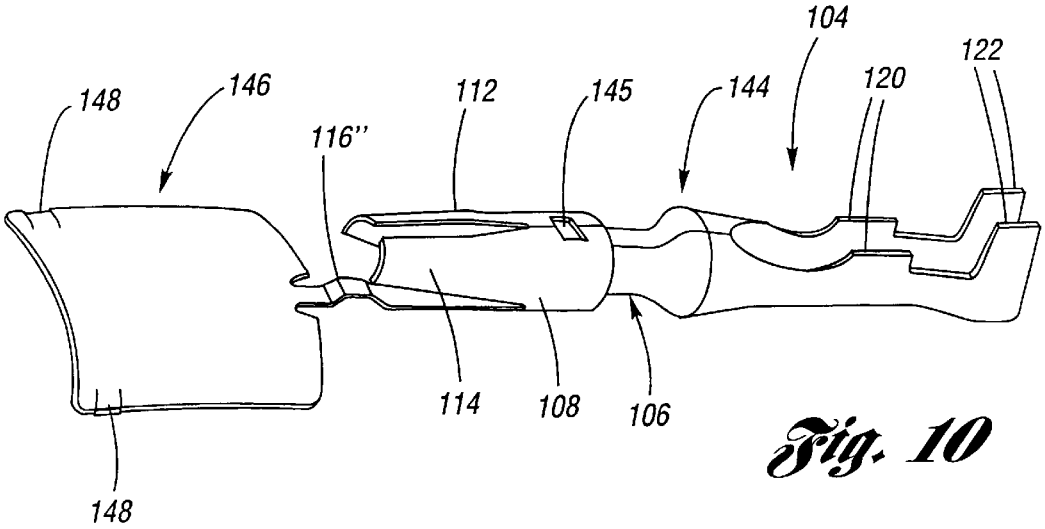
FIG. 10 is a perspective view of the die cut blank of FIG. 9 shown in an intermediate stage of forming into the female electrical terminal according to the present invention.
Figure 11:
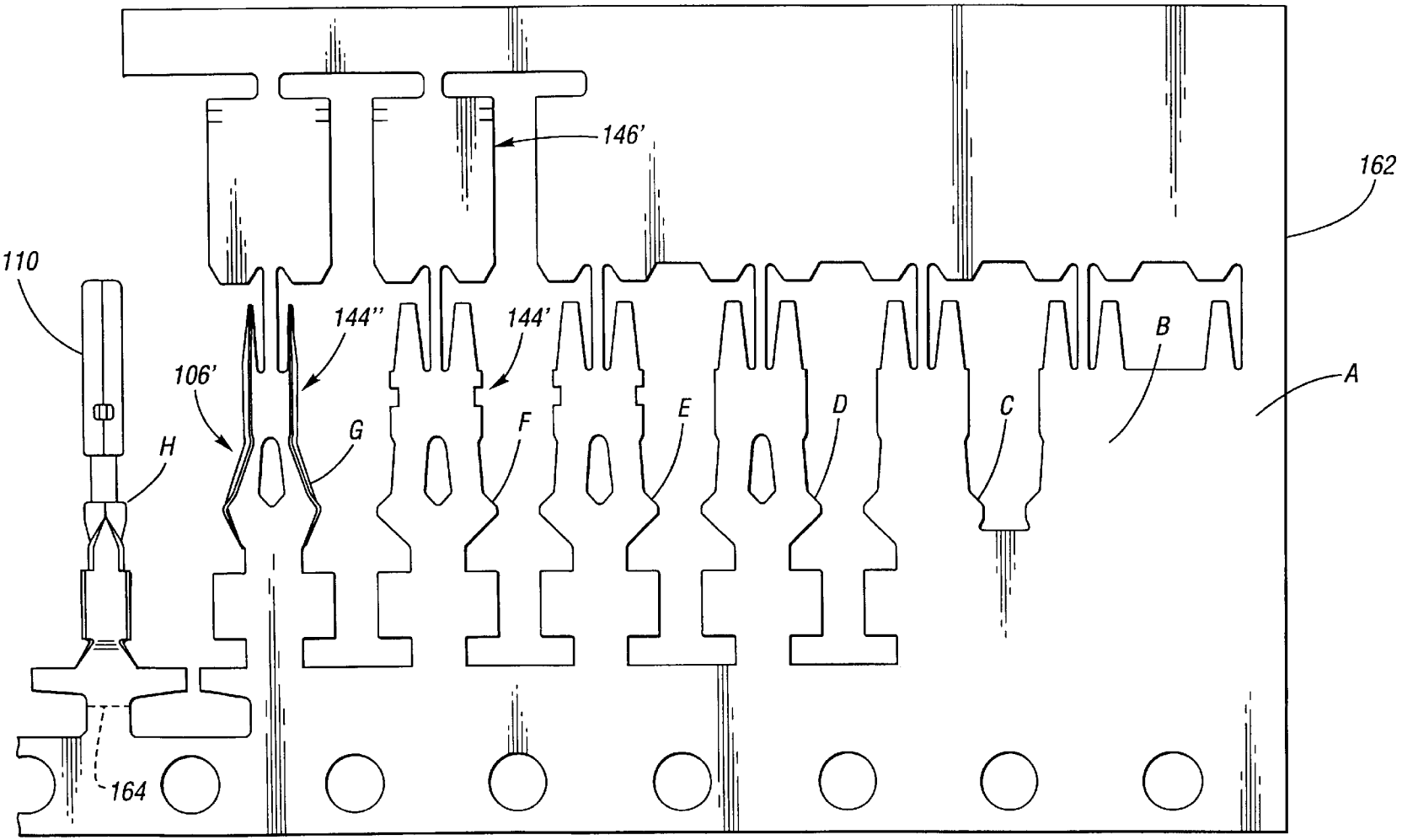
FIG. 11 is a plan view of a progression of steps for forming the female electrical terminal according to the present invention.

An example of fabrication steps for the female electrical terminal 100 is depicted at FIGS. 9 through 11.

FIG. 9 depicts a flat die cut blank 142 which is to be formed into the female electrical terminal 100. In this regard, a primary blank body 144 provides the inner barrel 108 and the cable connection portion 104 (discussed above). A strap 116' provides the strap 116 (discussed above), and a secondary blank body 146 provides the outer barrel 110 (discussed above). A pair of tabs 148 are preferably formed on the secondary blank body 146 for engagement with a window 145 (see FIG. 10) of the inner barrel 108 via notches 150 formed at the primary blank body 144. Further examination of the primary blank body 144 reveals first and second projections 152, 154 which will be formed into the first and second terminal arms 112, 114; and tab-like features 156, 158 which will be formed into the wire and insulation jacket crimp wings 120, 122. It will also be noted that the reduced diameter of the intermediate neck 106 is provided, in part, by the presence of a cut-out 160.

Turning attention now to FIG. 10, the primary blank body 144 is now fully formed, inclusive of the inner barrel 108 and the cable connection portion 104. The fold-over lip 134 is yet to be formed; the strap 116" is yet to be back-folded; and the secondary blank body 146 has yet to be wrapped around the inner barrel so as to thereby form the outer barrel therefrom.

FIG. 11 depicts a progression of differentiation and forming steps for fabricating the female electrical terminal 100 from flat sheet stock 162, composed of a suitable metallic conductor, as for example nickel, having, for example, 0.15 millimeters thickness. Precious metal plating may be applied to the sheet stock at the predetermined location of the yet to be formed female terminal contact 118. For example precious metal plating may be by: gold plating, palladium plating with a gold plated surface layer, or palladium plating with a silver plated surface layer. Various die cuts are made from steps A through F which provide substantial differentiation of the primary and secondary blank bodies 144', 146'. At step G, preliminary folding of the primary blank body 144" and intermediate neck 106 occurs. Between steps G and H, the inner barrel and intermediate neck are completely formed, the strap is provided with the embossment and back-folded, and the outer barrel 110 is formed by the secondary blank body being wrapped around the inner barrel, wherein the tabs are pressed seatingly into the window. Lastly a cut is made (at dashed line 164), whereupon the female electric terminal 100 (see FIG. 6) is provided.

To those skilled in the art to which this invention appertains, the above described preferred embodiments may be subject to change or modification. Such change or modification can be carried out without departing from the scope of the invention, which is intended to be limited only by the scope of the appended claims.

What is claimed is:

1. A single piece female electrical terminal comprising:

a terminal connection portion comprising an inner barrel, an outer barrel, and a strap integrally connecting said inner and outer barrels, said inner barrel having a forward end portion and a rear end portion, said forward end portion comprising a female terminal contact, wherein said outer barrel concentrically wraps said inner barrel, and wherein a rear end of said outer barrel forms an annular shoulder;

an intermediate neck integrally connected with said rear end portion of said inner barrel; and a cable connection portion integrally connected with said intermediate neck opposite said rear end portion of said inner barrel.

2. The female electrical connector of claim 1, wherein said outer barrel has an outer diameter, wherein said outer diameter is less than 1.8 millimeters.

3. The female electrical connector of claim 1, wherein said female terminal contact comprises:

a first terminal arm connected with said inner barrel;

a second terminal arm connected with said inner barrel; and a contact portion of said strap.

4. The female electrical connector of claim 3, wherein said contact portion comprises an embossment generally facing toward said first and second terminal arms.

5. The female electrical connector of claim 1, wherein said inner barrel has an inner diameter and said intermediate neck has a neck diameter, wherein said neck diameter is less than said inner diameter, and wherein a reduction taper bridges said inner diameter and said neck diameter; further wherein said reduction taper is disposed substantially within said outer barrel.

6. The female electrical terminal of claim 5, wherein said reduction taper is disposed completely within said outer barrel such that said annular shoulder is radially off-set in relation to said intermediate neck.

7. The female electrical terminal of claim 6, wherein said outer barrel forms an entry port axially forward of said female terminal contact.

8. The female electrical terminal of claim 7, wherein said inner barrel has an inner seam, said outer barrel has an outer seam aligned with said inner seam; further comprising barrel engagement means for engaging a portion of said outer seam with respect to said inner seam.

9. The female electrical connector of claim 7, wherein said female terminal contact comprises:

a first terminal arm connected with said inner barrel;

a second terminal arm connected with said inner barrel; and a contact portion of said strap.

10. The female electrical connector of claim 9, wherein said contact portion comprises an embossment generally facing toward said first and second terminal arms.

11. The female electrical terminal of claim 10, wherein said inner barrel has an inner seam, said outer barrel has an outer seam aligned with said inner seam; further comprising barrel engagement means for engaging a portion of said outer seam with respect to said inner seam.

12. The female electrical connector of claim 11, wherein said outer barrel has an outer diameter, wherein said outer diameter is less than 1.8 millimeters.

* * * * *